US007911391B2

(12) United States Patent
Tsai et al.

(10) Patent No.: US 7,911,391 B2
(45) Date of Patent: Mar. 22, 2011

(54) DUAL-BAND ANTENNA

(75) Inventors: Yung-Chih Tsai, Taipei Hsien (TW); Lan-Yung Hsiao, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 372 days.

(21) Appl. No.: 12/145,418

(22) Filed: Jun. 24, 2008

(65) Prior Publication Data

US 2009/0315781 A1 Dec. 24, 2009

(51) Int. Cl.
*H01Q 9/04* (2006.01)

(52) U.S. Cl. ..... 343/700 MS; 343/702; 343/829; 343/846

(58) Field of Classification Search ..... 343/700 MS, 343/702, 846, 848
See application file for complete search history.

(56) References Cited

U.S. PATENT DOCUMENTS

| | | | | |
|---|---|---|---|---|
| 7,333,067 | B2 * | 2/2008 | Hung et al. | 343/770 |
| 7,446,717 | B2 * | 11/2008 | Hung et al. | 343/702 |
| 7,501,987 | B2 * | 3/2009 | Wang et al. | 343/702 |
| 7,633,448 | B2 * | 12/2009 | Su et al. | 343/702 |
| 7,667,664 | B2 * | 2/2010 | Tao | 343/873 |
| 2008/0007461 | A1 * | 1/2008 | Su et al. | 343/700 MS |

* cited by examiner

*Primary Examiner* — Douglas W Owens
*Assistant Examiner* — Chuc D Tran
(74) *Attorney, Agent, or Firm* — WPAT, P.C.; Anthony King

(57) ABSTRACT

A dual-band antenna has a feeding conductor with a feeding point and a connecting portion extending downwardly from the feeding conductor. A first radiating conductor and a loop protrusion respectively extend outward from two opposite sides of the connecting portion. A grounding portion faces the loop protrusion and is spaced apart from the feeding conductor to form a small gap therebetween. A loop connection is disposed away from the feeding conductor and connects an upper portion of the loop protrusion and an upper portion of the grounding portion.

6 Claims, 9 Drawing Sheets

| | | |
|---|---|---|
| Mkr1a | 2300MHz | 3.396 |
| Mkr2a | 2700MHz | 1.796 |
| Mkr3a | 3300MHz | 1.568 |
| Mkr4a | 3800MHz | 3.803 |

| | | |
|---|---|---|
| Mkr1b | 2300MHz | 3.321 |
| Mkr2b | 2700MHz | 1.939 |
| Mkr3b | 3300MHz | 2.014 |
| Mkr4b | 3800MHz | 2.490 |

| | | |
|---|---|---|
| Mkr1c | 2300MHz | 2.7862 |
| Mkr2c | 2700MHz | 1.2394 |
| Mkr3c | 3300MHz | 2.2611 |
| Mkr4c | 3800MHz | 2.5907 |

DUAL-BAND ANTENNA

BACKGROUND OF THE INVENTION

1. Field of the Invention

The invention relates to a dual-band antenna, and particularly to a dual-band antenna with wide frequency range adapted to be configured in a wireless notebook.

2. The Related Art

As the wireless internet access technology continues to evolve, users are able to access the Internet at a higher speed at a fixed place where an internet station is located, such as a train station, a university and so on, covered by a wireless local area network (WLAN). As a result, a wireless notebook has become a mainstream product in the notebook market because it allows users to freely access the Internet, compared with the traditional notebook with wired internet access. Recently, a wireless worldwide interoperability for microwave access (WiMAX) communication technology has been developed. The WiMAX allows wireless communication carriers to have a higher capacity and a wider communication range without a significant attenuation so as to make it feasible to access the Internet at any place in a metropolitan area in which a WiMAX metropolitan area network (MAN) is constructed. The WiMAX applies two major frequency bands ranging between 2.3-2.7 giga-hertz (GHz) and between 3.3-3.8 GHz respectively. Accordingly, in response to the need for WiMAX application, a dual-bank antenna with its operating frequencies corresponding to the frequency bands of the WiMAX can be a suitable one.

Currently, there are many kinds of dual-band antennas designed to conform to frequency bands of the WiMAX. However, the dual-band antenna which is designed to receive and send electromagnetic signal between the frequency bands ranging within 2.3-2.7 GHz and within 3.3-3.8 GHz, especially the embedded antenna which is restrained by structure tends to cover lesser frequency range, the effect of the dual-band antenna receiving and sending electromagnetic signal cannot meet consumer's requirement. Therefore, a dual-band antenna which is capable of covering sufficiently wide frequency range is required accordingly.

SUMMARY OF THE INVENTION

An object of the present invention is to provide a dual-band antenna capable of covering biggish frequency range.

The dual-band antenna has a feeding conductor with a feeding point and a connecting portion extending downwardly from the feeding conductor. A first radiating conductor and a loop protrusion respectively extend outward from two opposite sides of the connecting portion. A grounding portion faces the loop protrusion and is spaced apart from the feeding conductor to form a small gap therebetween. A loop connection is disposed away from the feeding conductor and connects an upper portion of the loop protrusion and an upper portion of the grounding portion.

As described above, the feeding conductor, the connecting portion, the first radiating conductor form a monopole antenna component. The feeding conductor, the connection portion, the loop protrusion, the loop connection and the grounding portion form a loop antenna component. The monopole antenna component connects together with the loop antenna component, which extends frequency ranges of the dual-band antenna receiving and sending electromagnetic signal because of the interaction of the monopole antenna component and the loop antenna component. So the dual-band antenna is better than prior dual-band antenna used to cover the frequency bands ranging between 2.3-2.7 GHz and 3.3-3.8 GHz applied by the WiMAX.

BRIEF DESCRIPTION OF THE DRAWINGS

The present invention will be apparent to those skilled in the art by reading the following description of an embodiment thereof, with reference to the accompanying drawings, in which.

DETAILED DESCRIPTION OF THE PREFERRED EMBODIMENT

Figure 1:
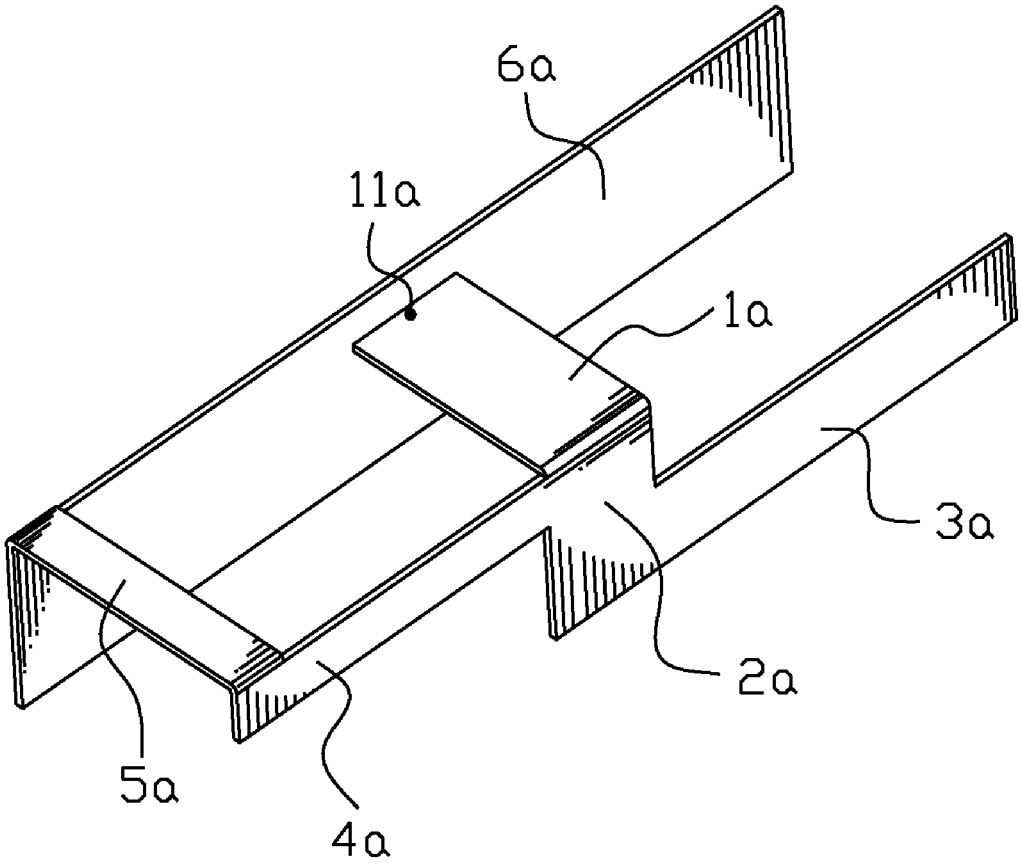
FIG. 1 is a perspective view illustrating the structure of a dual-band antenna according to a first embodiment of the present invention.

Please refer to FIG. 1, a first embodiment of a dual-band antenna according to the present invention is shown. The dual-band antenna has a feeding conductor 1*a* which is disposed in a horizontal manner and which defines a feeding point 11*a* at an end thereof. The feeding conductor 1*a* is an oblong flat-board shape. The other end of the feeding conductor 1*a* opposite to the feeding point 11*a* extends downwardly to form an oblong flat-board shaped connecting portion 2*a*. The connecting portion 2*a* may be perpendicular to the feeding conductor 1*a* and may define two opposite sides. A first radiating conductor 3*a* extends outwardly from a bottom of one side of the connecting portion 2*a*. The first radiating conductor 3*a* is formed as an elongated shape, for example a rectangular shape.

The feeding conductor 1*a*, the connecting portion 2*a*, and the first radiating conductor 3*a* constitute cooperatively a monopole antenna component. When the dual-band antenna operates at wireless communication, the current is fed from the feeding point 11*a* of the feeding conductor 1*a* to the first radiating conductor 3*a* to generate an electrical resonance corresponding to a quarter wavelength corresponding to a frequency band ranging within 2.3-2.7 GHz of the WiMAX.

The other side of the connecting portion 2*a* extends outward to form a loop protrusion 4*a* at a top thereof. The loop protrusion 4*a* is an elongated shape. A top side of a free end of the loop protrusion 4*a* perpendicularly extends to form a loop connection 5*a* which is away from the feeding conductor 1*a*. The loop connection 5*a* is of bar-board shape and stays at the same level as the feeding portion 1*a*. A free end of the loop connection 5*a* connects a top side of an end of a grounding portion 6*a*. The grounding portion 6*a* faces the loop protrusion 4*a* and may share the same length with the totality of the loop protrusion 4*a*, the connection portion 2*a* and the first radiating conductor 3*a*, and is apart from the feeding conductor 1*a* to form a small gap therebetween.

The feeding conductor 1*a*, the connection portion 2*a*, the loop protrusion 4*a*, the loop connection 5*a* and the grounding portion 6*a* form cooperatively a loop antenna component. When the dual-band antenna operates at wireless communication, the current is fed from the feeding point 11*a* of the feeding conductor 1*a* to the grounding portion 6*a* to result in an electrical resonance corresponding to a half wavelength corresponding to a frequency band ranging between 3.3-3.8 GHz of the WiMAX.

Figure 2:
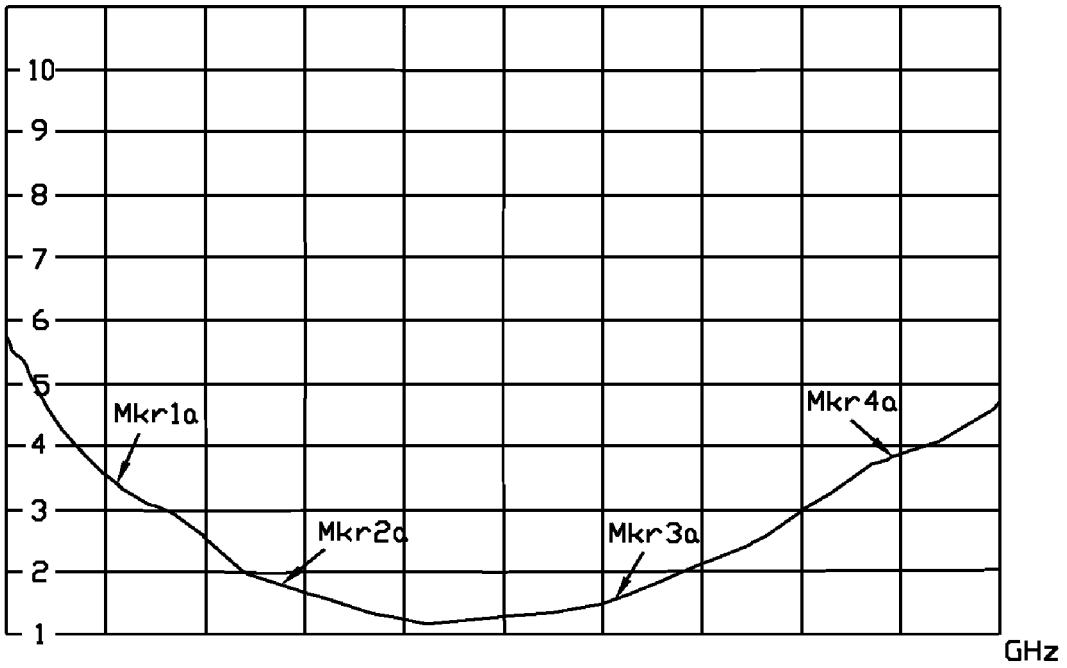
FIG. 2 shows a Voltage Standing Wave Ratio (VSWR) test chart of the dual-band antenna shown in FIG. 1.

Referring to FIG. 2, which shows a Voltage Standing Wave Ratio (VSWR) test chart of the dual-band antenna in the first embodiment when the dual-band antenna operates at wireless communication. When the dual-band antenna operates at a frequency of 2.3 GHz (indicator Mr1*a* in FIG. 2), the resulting VSWR value is 3.396. When the dual-band antenna operates at a frequency of 2.7 GHz (indicator Mr2*a* in FIG. 2), the resulting VSWR value is 1.796. When the dual-band antenna operates at a frequency of 3.3 GHz (indicator Mr3*a* in FIG. 2), the resulting VSWR value is 1.568. When the dual-band antenna operates at a frequency of 3.8 GHz (indicator Mkr4*a* in FIG. 2), the resulting VSWR value is 3.803.

Figure 3:
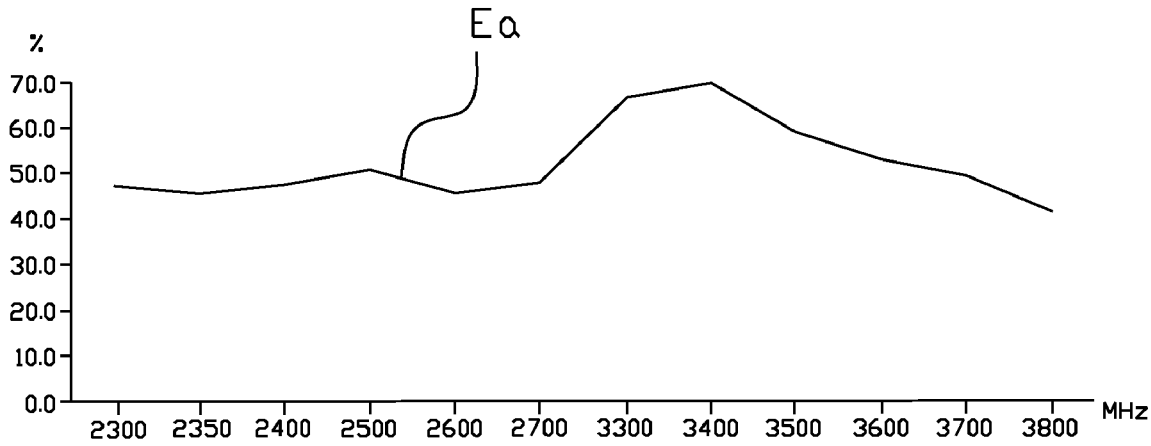
FIG. 3 is a graph showing the efficiency Ea against frequency in MHz for the dual-band antenna shown in FIG. 1.

Referring to FIG. 3, which shows the efficiency Ea against frequency in MHz for the dual-band antenna in the first embodiment. When the dual-band antenna operates at the frequency ranging between 2.3 GHz and 2.7 GHz, the efficiency is between 45.5 percentages and 52.0 percentages, and the average efficiency is 51.2 percentages. When the dual-band antenna operates at the frequency range covering between 3.3 GHz and 3.8 GHz, the efficiency is between 41.9 percentages and 70.1 percentages, and the average efficiency is 55.3 percentages.

Figure 4:
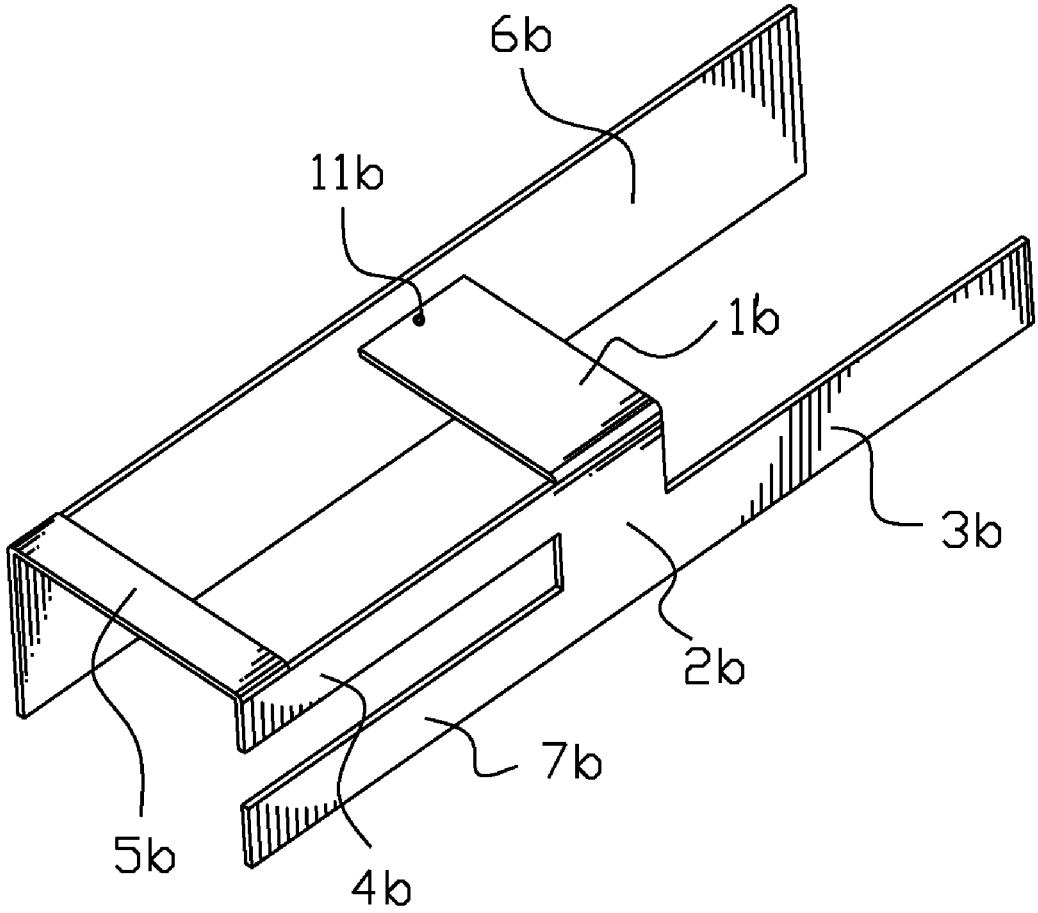
FIG. 4 is a perspective view illustrating the structure of a dual-band antenna according to a second embodiment of the present invention.

Referring to FIG. 4, a dual-band antenna in accordance with a second embodiment of the present invention is illustrated. In comparison with the dual-band antenna in the first embodiment, the dual-band antenna in the second embodiment further includes a protrusion portion 7*b*. The protrusion portion 7*b* extends from a bottom of the side of the connecting portion 2*b* so as to be parallel and spaced away from the loop protrusion 4*b*. The protrusion portion 7*b* is of bar-board shape and extends to have the same length as the loop protrusion 4*b*. The feeding conductor 1*b*, the connection portion 2*b*, the loop protrusion 4*b*, the loop connection 5*b*, the grounding portion 6*b* and the protrusion portion 7*b* together form a loop antenna component which causes an electrical resonance corresponding to a half wavelength corresponding to a frequency band ranging from 3.3-3.8 GHz of the WiMAX.

Figure 5:
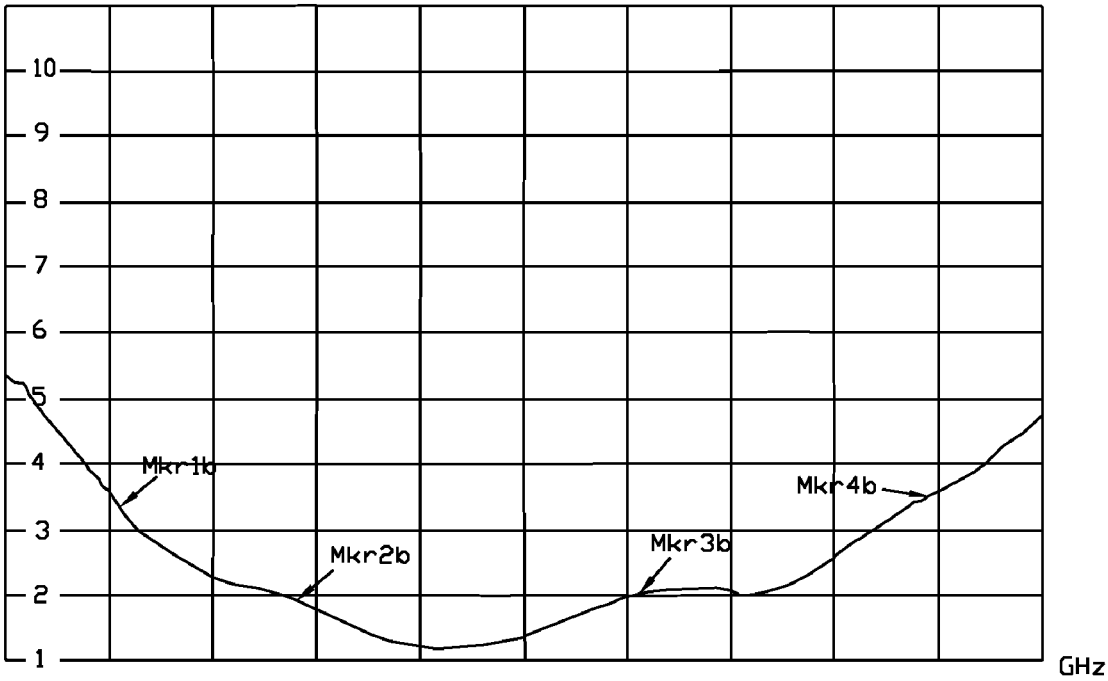
FIG. 5 shows a VSWR test chart of the dual-band antenna shown in FIG. 4.

Referring to FIG. 5, which shows a VSWR test chart of the dual-band antenna in the second embodiment when the dual-band antenna operates at wireless communication. When the dual-band antenna operates at a frequency of 2.3 GHz (indicator Mr1*b* in FIG. 5), the resulting VSWR value is 3.321. When the dual-band antenna operates at a frequency of 2.7 GHz (indicator Mr2*b* in FIG. 5), the resulting VSWR value is 1.939. When the dual-band antenna operates at a frequency of 3.3 GHz (indicator Mr3*b* in FIG. 5), the resulting VSWR value is 2.014. When the dual-band antenna operates at a frequency of 3.8 GHz (indicator Mkr4*b* in FIG. 5), the resulting VSWR value is 2.490.

Figure 6:
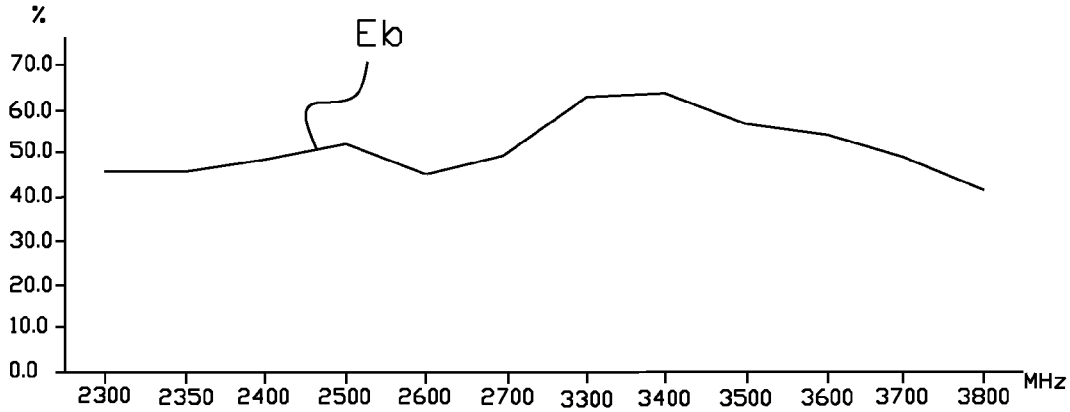
FIG. 6 is a graph showing the efficiency Eb against frequency in MHz for the dual-band antenna shown in FIG. 4.

With reference to FIG. 6, which shows the efficiency Eb against frequency in MHz for the dual-band antenna in the second embodiment. When the dual-band antenna operates at the frequency ranging between 2.3 GHz and 2.7 GHz, the efficiency is between 45.5 percentages and 52.0 percentages, and the average efficiency is 50.5 percentages. When the dual-band antenna operates at the frequency ranging between 3.3 GHz and 3.8 GHz, the efficiency is between 42.2 percentages and 63.6 percentages, and the average efficiency is 53.4 percentages.

Figure 7:
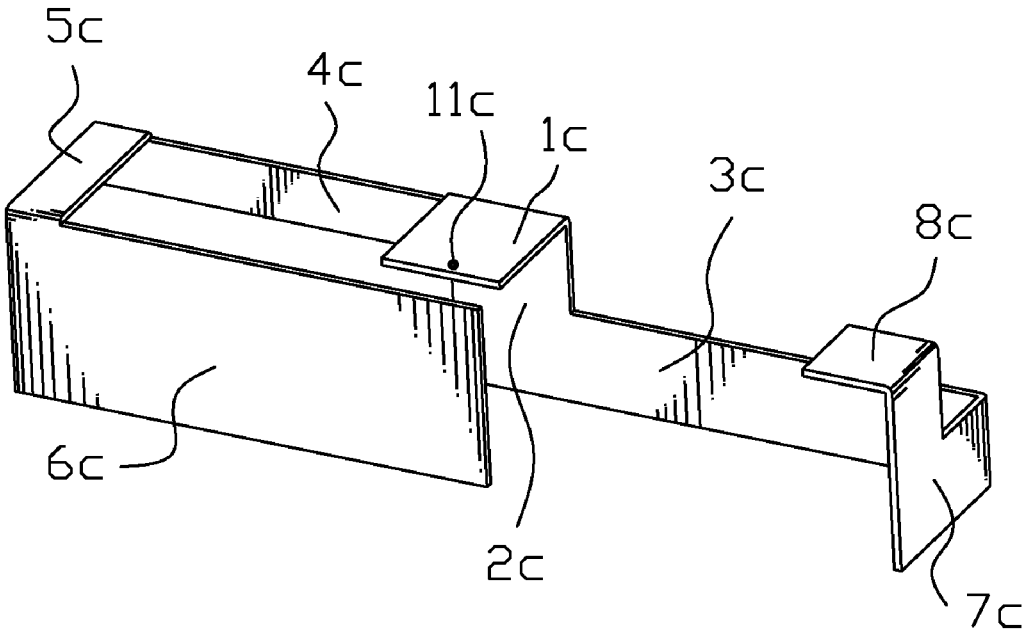
FIG. 7 is a perspective view illustrating the structure of a dual-band antenna according to a third embodiment of the present invention.

With reference to FIG. 7, a dual-band antenna in according with a third embodiment of the present invention is shown. In comparison with the dual-band antenna in the first embodiment, the dual-band antenna in the third embodiment further includes a linking portion 7*c* and a second radiating conductor 8*c*. The linking portion 7*c* substantially perpendicularly extends from a free end of the first radiating conductor 3*c* and then bends upwardly to show an L-shape. The linking portion 7*c* is disposed at the same side of the first radiating conductor 3*c* as the feeding conductor 1*c*. A top side of the linking portion 7*c* bends toward the feeding conductor 1*c* and then extends to form a second radiating conductor 8*c*. The second radiating conductor 8*c* is of flat-board shape and stays at the same level as the feeding conductor 1*c*. In additional, in this embodiment, the grounding portion 6*c* faces and equates in length with the loop protrusion 4*c* and the connecting portion 2*c*. The feeding conductor 1*c*, the connecting portion 2*c*, the first radiating conductor 3*c*, the linking portion 7*c* and the second radiating conductor 8*c* together create a monopole antenna component which induces an electrical resonance corresponding to a quarter wavelength corresponding to a frequency band ranging from 2.3-2.7 GHz of the WiMAX.

Figure 8:
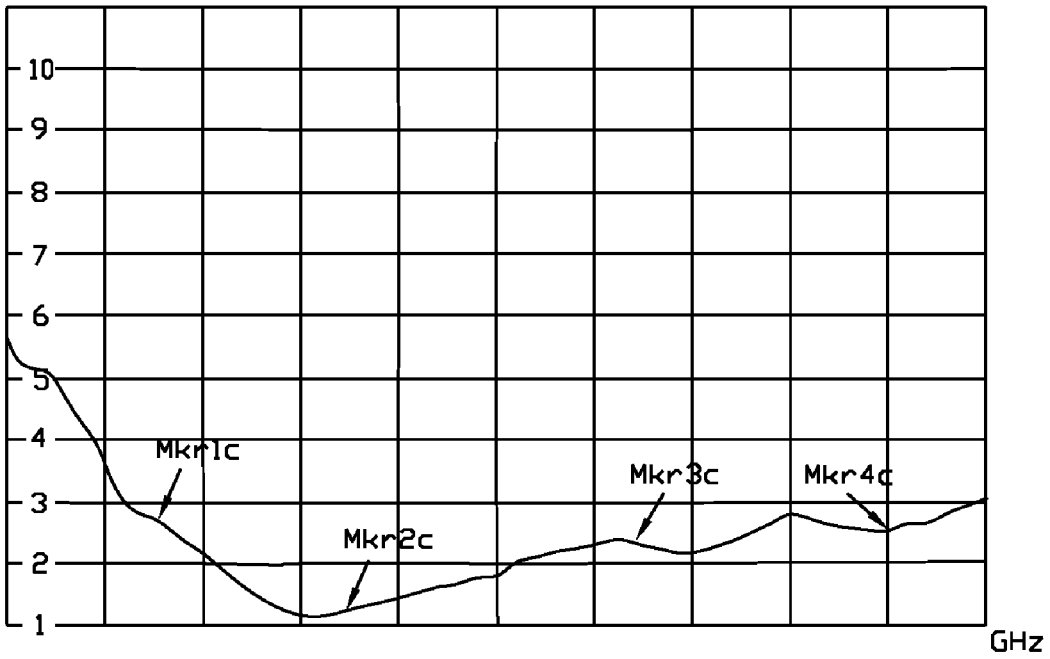
FIG. 8 shows a VSWR test chart of the dual-band antenna shown in FIG. 7.

Now with reference to FIG. 8, which shows a VSWR test chart of the dual-band antenna in the third embodiment when the dual-band antenna operates at wireless communication. When the dual-band antenna operates at a frequency of 2.3 GHz (indicator Mr1*c* in FIG. 8), the resulting VSWR value is 2.7862. When the dual-band antenna operates at a frequency of 2.7 GHz (indicator Mr2*c* in FIG. 8), the resulting VSWR value is 1.2394. When the dual-band antenna operates at a frequency of 3.3 GHz (indicator Mr3*c* in FIG. 8), the resulting VSWR value is 2.2611. When the dual-band antenna operates at a frequency of 3.8 GHz (indicator Mkr4*c* in FIG. 8), the resulting VSWR value is 2.5907.

Figure 9:
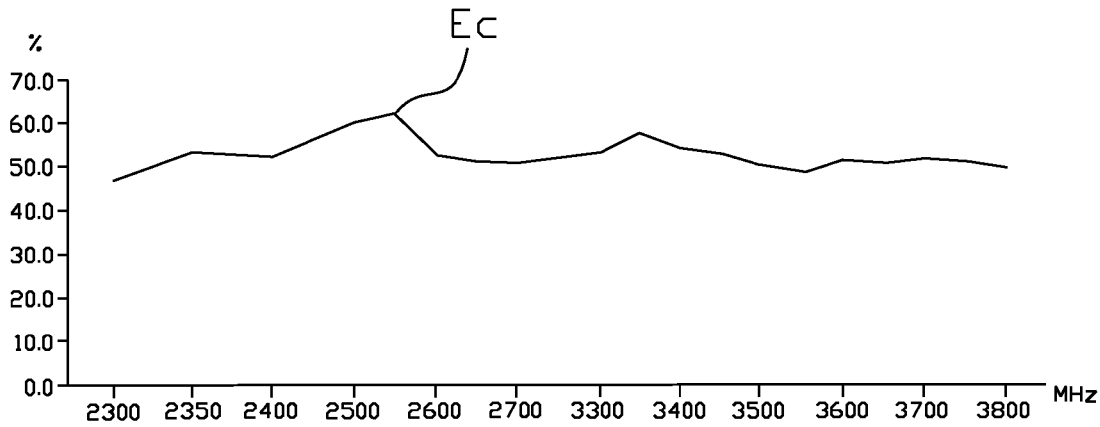
FIG. 9 is a graph showing the efficiency Ec against frequency in MHz for the dual-band antenna shown in FIG. 7.

Reference is now made to FIG. 9, which shows the efficiency Ec against frequency in MHz for the dual-band antenna in the third embodiment. When the dual-band antenna operates at the frequency range covering between 2.3 GHz and 2.7 GHz, the efficiency is between 48.47 percentages and 62.88 percentages, and the average efficiency is 54.51 percentages. When the dual-band antenna operates at the frequency range covering between 3.3 GHz and 3.8 GHz, the efficiency is between 48.43 percentages and 59.33 percentages, and the average efficiency is 52.02 percentages.

As described above, because the monopole antenna component connects together with the loop antenna component, the dual-band antenna is almost able to receive and send all electromagnetic signal between the frequency ranges covering between 2.3 GHz and 2.7 GHz, and 3.3 GHz and 3.8 GHz, and further is able to improve the efficiency thereof because of the interaction of the monopole antenna component and the loop antenna component. Hence, the dual-band antenna is better than prior dual-band antenna used to cover the frequency bands ranging within 2.3-2.7 GHz and 3.3-3.8 GHz applied by the WiMAX.

Furthermore, the present invention is not limited to the embodiments described above; various additions, alterations and the like may be made within the scope of the present invention by a person skilled in the art. For example, respective embodiments may be appropriately combined.

What is claimed is:

1. A dual-band antenna comprising:

a feeding conductor with a feeding point;

a connecting portion extending downwardly from one end of the feeding conductor;

a first radiating conductor extending from one side of the connecting portion;

a loop protrusion extending opposite to the first radiating conductor from the other side of the connecting portion;

a grounding portion facing the loop protrusion and spaced apart from the feeding conductor to form a small gap therebetween;

a loop connection disposed away from the feeding conductor and connecting an upper portion of the loop protrusion and an upper portion of the grounding portion; and a linking portion substantially perpendicularly connected to a free end of the first radiating conductor and disposed at the same side of the first radiating conductor as the feeding conductor.

2. The dual-band antenna as claimed in claim 1, wherein an upper portion of the linking portion bends towards the feeding conductor to form a second radiating conductor.

3. The dual-band antenna as claimed in claim 2, wherein the feeding conductor, the second radiating conductor and the loop connection are arranged at the same level.

4. The dual-band antenna as claimed in claim 2, wherein a free end of the grounding portion is elongated to equate in length to the connecting portion and the loop protrusion.

5. A dual-band antenna comprising:

a feeding conductor with a feeding point;

a connecting portion extending downwardly from one end of the feeding conductor;

a first radiating conductor extending from one side of the connecting portion;

a loop protrusion extending opposite to the first radiating conductor from the other side of the connecting portion;

a grounding portion facing the loop protrusion and spaced apart from the feeding conductor to form a small gap therebetween;

a loop connection disposed away from the feeding conductor and connecting an upper portion of the loop protrusion and an upper portion of the grounding portion; and a protrusion portion extending from the same side of the connecting portion as the loop protrusion and located below the loop protrusion to form a space therebetween.

6. The dual-band antenna as claimed in claim 5, wherein the grounding portion is elongated to equate in length to the loop protrusion, the connecting portion and the first radiating conductor.

* * * * *